US009607587B2

(12) United States Patent
Suzuki et al.

(10) Patent No.: US 9,607,587 B2
(45) Date of Patent: Mar. 28, 2017

(54) HAMMER DEVICE AND KEYBOARD DEVICE FOR ELECTRONIC KEYBOARD INSTRUMENT

(71) Applicant: Kabushiki Kaisha Kawai Gakki Seisakusho, Hamamatsu-shi, Shizuoka-ken (JP)

(72) Inventors: Akihiro Suzuki, Hamamatsu (JP); Hideyuki Ishida, Hamamatsu (JP)

(73) Assignee: KABUSHIKI KAISHA KAWAI GAKKI SEISAKUSHO, Hamamatsu-shi (JP)

( * ) Notice: Subject to any disclaimer, the term of this patent is extended or adjusted under 35 U.S.C. 154(b) by 0 days.

(21) Appl. No.: 14/527,491

(22) Filed: Oct. 29, 2014

(65) Prior Publication Data

US 2015/0068384 A1 Mar. 12, 2015

Related U.S. Application Data

(62) Division of application No. 13/689,404, filed on Nov. 29, 2012, now Pat. No. 9,006,549.

(30) Foreign Application Priority Data

Dec. 16, 2011 (JP) ..... 2011-275291
Dec. 16, 2011 (JP) ..... 2011-275292

(51) Int. Cl.

| | |
|---|---|
| ***G10C 3/18*** | (2006.01) |
| ***G10H 1/34*** | (2006.01) |
| ***G10B 3/12*** | (2006.01) |

(52) U.S. Cl.
CPC ..... *G10C 3/18* (2013.01); *G10B 3/12* (2013.01); *G10H 1/34* (2013.01); *G10H 1/346* (2013.01)

(58) Field of Classification Search
CPC ..... G10C 3/18; G10H 1/34
USPC ..... 84/243, 423 R
See application file for complete search history.

(56) References Cited

U.S. PATENT DOCUMENTS 2,620,700 A * 12/1952 Shill ..... G10C 3/225 84/238
5,406,875 A * 4/1995 Tamai et al. ..... 84/433
7,550,659 B2 * 6/2009 Shimoda ..... 84/251

FOREIGN PATENT DOCUMENTS

JP 3270693 1/2002
JP 3591579 9/2004

* cited by examiner

*Primary Examiner* — Jianchun Qin
(74) *Attorney, Agent, or Firm* — Lewis Roca Rothgerber Christie LLP

(57) ABSTRACT

A hammer device of an electronic piano with keys which swing in accordance with key depression, includes a hammer support that is made of a synthetic resin and has a fulcrum shaft, and a hammer having a shaft hole part for being fitted on the fulcrum shaft and configured to pivotally move about the fulcrum shaft in a manner interlocked with the swinging key. The fulcrum shaft has an outer peripheral surface formed by a pair of arcuately-curved surface portions opposite to each other and a pair of planar surface portions each extending between the pair of arcuately-curved surface portions and parallel to each other.

2 Claims, 14 Drawing Sheets

HAMMER DEVICE AND KEYBOARD DEVICE FOR ELECTRONIC KEYBOARD INSTRUMENT

CROSS-REFERENCE TO RELATED APPLICATION(S)

This application is a divisional of U.S. patent application Ser. No. 13/689,404, filed Nov. 29, 2012, which claims priority to and benefit of Japanese Patent Application Number 275291/2011, filed on Dec. 16, 2011 and Japanese Patent Application Number 275292/2011, filed on Dec. 16, 2011, the entire disclosures of which are incorporated herein by reference.

BACKGROUND OF THE INVENTION

Field of the Invention

The present invention relates to a keyboard device for an electronic keyboard instrument including swingable keys and a hammer device having hammers each of which pivotally moves by being pushed up by a depressed key.

Description of the Related Art

Conventionally, as a hammer device for an electronic keyboard instrument, there has been known one disclosed e.g. in Japanese Patent Publication No. 3270693. The electronic keyboard instrument includes a chassis, a plurality of swingable keys provided on the chassis, wippens provided for the respective keys, and a center rail having the hammer device mounted thereon. The hammer device includes a plurality of hammers each made of a synthetic resin. The hammers are arranged side by side in association with the respective keys. Each of the hammers has a front end thereof integrally formed with a pivotal shaft.

On the other hand, the center rail has a bearing member and a bearing member fixing plate, and the bearing member is formed with a U-shaped hole. The bearing member fixing plate is secured to the bearing member with screws with the pivotal shaft of each hammer fitted in the hole of the bearing member, whereby the hammer is supported by the bearing member and the bearing member fixing plate such that the hammer can pivotally move about the pivotal shaft. In this electronic keyboard instrument, when one of the keys is depressed, a wippen associated with the depressed key pivotally moves, and an associated hammer pivotally moves in accordance with the pivotal movement of the wippen.

Further, as a keyboard device for an electronic keyboard instrument of the above-mentioned type, there has also been known one disclosed in Japanese Patent Publication No. 3591579. This keyboard device includes swingable keys, pivotally movable hammers, and switches for detecting key depression information on the respective keys, and each hammer has a capstan screw screwed therein. The hammer is placed on an associated one of the keys via the capstan screw. When depressed, the key pushes up the hammer via the capstan screw. As a consequence, the hammer pivotally moves to press the switch, whereby key depression information is detected and a musical tone is generated based on the detected key depression information. The angle of the capstan screw, as viewed laterally, with respect to a vertical direction is set to be larger in a fully depressed state of the key (i.e. in a state where a key depression has been completed) than when the key is in a key-released state.

According to the hammer device for an electronic keyboard instrument disclosed in Japanese Patent Publication No. 3270693, the hammer is made of a synthetic resin, and therefore, in the case of manufacturing the hammer e.g. by injection molding, it is required to use two molds B1 and B2 such that the center of a hammer pivot shaft A1 is positioned on a parting line between the molds B1 and B2, as shown in FIG. 16. In this case, there is a fear that parting line marks and molding burrs are generated on the outer peripheral surface of the pivot shaft A1.

If the hammer is used with the above-mentioned parting line marks and molding burrs left on the pivot shaft A1, the parting line marks and the molding burrs will interfere with the inner peripheral surface of the hole of the bearing member during pivotal movement of the hammer, which hinders smooth pivotal movement of the hammer. For this reason, it is required to perform cutting during manufacturing of the hammer so as to remove the parting line marks and the molding burrs, which increases the number of manufacturing steps and manufacturing costs.

Further, in the hammer device disclosed in Japanese Patent Publication No. 3270693, each hammer is supported by the bearing member and the bearing member fixing plate fixed to the bearing member with screws, so that when removing a hammer from the center rail and mounting the hammer to the center rail e.g. for maintenance, it is required to carry out screw-out and screw-in operations, which causes degradation of workability.

On the other hand, in a keyboard device of the type disclosed in Japanese Patent Publication No. 3591579, since the tone volume of a musical tone is controlled according to the pivotal speed of a hammer that presses the switch, it is preferred that the pivotal speed of each hammer can be finely adjusted so as to achieve musical performance rich in expression. For example, a weak tone, such as a pianissimo tone, can be obtained by temporarily causing a hammer to pivotally move to a location close to the switch and then further pivotally moving the hammer from this state to thereby reduce the pivotal speed of the hammer when the hammer presses the switch.

Further, to make it easy for a player to adjust the pivotal speed of a hammer so as to ensure excellent musical performance capability of the keyboard device, it is important to set the touch weight (load applied on a player's finger) of each key to an appropriate magnitude. In particular, in order to obtain an appropriate weak tone, it is important to appropriately set a touch weight occurring when an associated hammer having pivotally moved close to the switch is further pivotally moved, i.e. a touch weight immediately before termination of a key depression. The hammer is placed on the key via the capstan screw, so that the touch weight is determined by a reaction force of the hammer acting on the key via the capstan screw, and other factors. The hammer reaction force is generated by the weight of the hammer itself, and basically acts vertically.

In the keyboard device disclosed in Japanese Patent Publication No. 3591579, the angle of the capstan screw with respect to the vertical direction is set to be larger in the state where a key depression has been completed than when the key is in the key-released state. For this reason, a force component, which acts in a direction perpendicular to the axis of the capstan screw, of the reaction force of the hammer which acts vertically, is increased immediately before termination of a key depression, which hinders appropriate transmission of the reaction force of the hammer to the key via the capstan screw, resulting in reduction of touch weight. In the conventional keyboard device, the touch weight thus provided immediately before termination of a key depression becomes insufficient, so that it is impossible to appropriately adjust the pivotal speed of the hammer, and in turn impossible to provide excellent musical performance capability.

SUMMARY OF THE INVENTION

It is a first object of the present invention to provide a hammer device for an electronic keyboard instrument, which makes it possible to reduce the number of manufacturing steps and manufacturing costs as well as to improve workability during maintenance.

It is a second object of the present invention to provide a keyboard device for an electronic keyboard instrument, which makes it possible to secure sufficient touch weight during key depression to thereby provide excellent musical performance capability.

To attain the above first object, in a first aspect of the present invention, there is provided a hammer device for an electronic keyboard instrument having a key which swings in accordance with key depression, comprising a hammer support that is made of a synthetic resin and has a fulcrum shaft, and a hammer that has a fitting part for being fitted on the fulcrum shaft and is configured to pivotally move about the fulcrum shaft in a manner interlocked with the swinging key, wherein the fulcrum shaft has an outer peripheral surface which is formed by a pair of arcuately-curved surface portions opposite to each other, and a pair of planar surface portions each extending between the pair of arcuately-curved surface portions and parallel to each other, and wherein the hammer is configured to pivotally move with the fitting part held in surface contact with the pair of arcuately-curved surface portions of the fulcrum shaft.

According to this hammer device, the hammer support has the fulcrum shaft, and the outer peripheral surface of the fulcrum shaft is formed by the pair of arcuately-curved surface portions opposite to each other and the pair of planar surface portions each extending between the arcuately-curved surface portions and parallel to each other. Further, the hammer has the fitting part fitted on the fulcrum shaft, and is pivotally moved about the fulcrum shaft in a manner interlocked with the swinging key. In this case, the hammer support is made of a synthetic resin. Therefore, in the case of manufacturing the hammer support e.g. by injection molding using molds, the molds are configured such that the parting line between the molds passes a boundary between one of the arcuately-curved surface portions and one of the planar surface portions and a boundary between the other of the arcuately-curved surface portions and the other of the planar surface portions (see FIG. 7). By this configuration, even if parting line marks or the like are generated, it is possible to limit portions where the marks are generated to the two boundary portions between the arcuately-curved surface portions and the planar surface portions. Further, since the hammer is pivotally moved with the fitting part held in surface contact with the pair of arcuately-curved surface portions of the fulcrum shaft, even if parting line marks or the like are formed on the fulcrum shaft, at least one of the parting line marks is elastically deformed during the pivotal movement of the hammer in a manner bent toward the planar surface portions, so that smooth pivotal movement of the hammer is not hindered. This makes it possible to dispense with a cutting process for removing the parting line marks and the like, thereby contributing to reduction of the number of manufacturing steps and manufacturing costs.

Preferably, the fitting part has an upwardly open shaft hole having an arcuate inner peripheral surface, the pair of arcuately-curved surface portions of the fulcrum shaft are disposed at respective locations upward and downward of an axis of the fulcrum shaft and are fitted in the shaft hole of the fitting part, a width of an opening of the shaft hole of the fitting part is set to be shorter than a vertex-to-vertex distance between the pair of arcuately-curved surface portions and is longer than a distance between the planar surface portions, and the hammer has a contact part in contact with an upper surface of the key, and the contact part is pushed upward by the key when the key is swung, whereby the hammer is pivotally moved about the fulcrum shaft.

With the configuration of this preferred embodiment, the fitting part has the upwardly open shaft hole having the arcuate inner peripheral surface, and the arcuately-curved surface portions of the fulcrum shaft are positioned at respective locations upward and downward of the axis of the fulcrum shaft and fitted in the shaft hole of the fitting part. Further, the width of the opening of the shaft hole is shorter than the vertex-to-vertex distance between the arcuately-curved surface portions and longer than the distance between the planar surface portions. This enables, during maintenance, a worker to pivotally move the hammer to a position where the center of one of the arcuately-curved surface portions coincides with that of the opening of the shaft hole, and then move the hammer downward to thereby dismount the same from the hammer support. When the hammer is to be mounted to the hammer support, operations reverse to the above dismounting operations can be carried out. In short, the worker can mount and dismount the hammer to and from the hammer support simply by manually turning the hammer, without carrying out any screw-in and screw-out operations, which contributes to improvement of workability during maintenance. In addition, the hammer has the contact part held in contact with the upper surface of the key, and when the key is swung, the contact part is pushed upward by the key, whereby the hammer is pivotally moved about the fulcrum shaft. Therefore, it is possible to appropriately support an upward force acting on the fulcrum shaft when the key starts to be swung, by the lower one of the arcuately-curved surface portions of the fulcrum shaft.

To attain the second object, in a second aspect of the present invention, there is provided a keyboard device for an electronic keyboard instrument comprising a key that extends in a front-rear direction and is swingable about its center or portion close thereto, a hammer that is pivotally movable about a hammer fulcrum; and a capstan screw that is provided on one of the key and the hammer and is in contact with the other of the key and the hammer, wherein the hammer is placed on a rear end of the key via the capstan screw, and is pushed up by the key in accordance with depression of the key, and wherein an angle of the capstan screw, as viewed laterally, with respect to a vertical direction is set to be smaller when the key is in a fully depressed state than when the key is in a key-released state.

According to this keyboard device, the key extends in the front-rear direction in a manner swingable about its center or portion close thereto, and the hammer can be pivotally moved about the hammer fulcrum. Further, the capstan screw provided on one of the key and the hammer is in contact with the other of the key and the hammer. The hammer is placed on the rear end of the key via the capstan screw, and is pushed up by the key in accordance with depression of the key, to thereby perform upward pivotal movement. Since the hammer is thus placed on the key via the capstan screw, a reaction force generated by the weight of the hammer itself acts on the key basically vertically. The touch weight (load applied on a player's finger) of the key is determined by the reaction force of the hammer etc.

With the arrangement described above, the angle of the capstan screw, as viewed laterally, with respect to the vertical direction is set to be smaller in the fully depressed state of the key, i.e. when a key depression is terminated than when the key is in the key-released state. This makes it possible to reduce a force component which acts in a direction at right angles to the axis of the capstan screw, of the reaction force of the hammer which acts vertically during key depression, i.e. over a time period from the start of the key depression to the end of the same, to thereby appropriately transmit the reaction force of the hammer to the key via the capstan screw. Therefore, it is possible to secure sufficient touch weight during the key depression and thereby provide excellent musical performance capability. In particular, differently from the conventional keyboard device described hereinbefore, the keyboard device of the present invention makes it possible to secure sufficient touch weight immediately before termination of a key depression, so that it is possible to more effectively provide excellent musical performance capability.

Preferably, when the key is in the key-released state, the hammer fulcrum and a gravity center of the hammer are positioned at substantially same height.

As described hereinbefore, the hammer is pivotally movable about the hammer fulcrum, and is placed on the key. The hammer is thus supported by the hammer fulcrum and the key. Assuming that the hammer fulcrum is lower than the gravity center of the hammer when the key is in the key-released state, a force component which acts in the lengthwise direction of the hammer, of the gravity (reaction force) of the hammer, which acts in the vertical direction, is increased, so that a portion supported by the hammer fulcrum is increased, and a portion supported by the key is reduced accordingly. Therefore, when the key is depressed, the hammer fulcrum becomes further lower than the gravity center of the hammer in accordance with upward pivotal movement of the hammer, and this further increases the force component which acts in the lengthwise direction of the hammer, and the reaction force of the hammer, which acts on the key, is further reduced. In contrast, with the arrangement described above, when the key is in the key-released state, the hammer fulcrum and the gravity center of the hammer are positioned at substantially same height, so that it is possible to reduce the force component which acts in the lengthwise direction of the hammer than when the hammer fulcrum is lower than the gravity center of the hammer, to thereby increase the reaction force of the hammer which acts on the key during key depression, i.e. touch weight. This makes it possible to more effectively obtain the above-mentioned advantageous effects that sufficient touch weight can be secured during key depression, and thereby provide more excellent musical performance capability.

The above and other objects, features, and advantages of the present invention will become more apparent from the following detailed description taken in conjunction with the accompanying drawings.

BRIEF DESCRIPTION OF THE DRAWINGS

FIGS. 8A and 8B are views of the hammer, in which FIG. 8A shows the hammer in plan view, and FIG. 8B shows the hammer in side view;

FIGS. 10A and 10B are views useful in explaining the operation of the hammer, in which FIG. 10A shows a state where the hammer is in its home position, and FIG. 10B shows a state where the hammer has pivotally moved to its turning limit position;

FIGS. 14A and 14B are views of a comparative example of the capstan screw in which FIG. 14A shows an angle of the capstan screw with respect to a vertical line perpendicular to a cloth, and FIG. 14B shows a contact area of the capstan screw on the cloth;

DETAILED DESCRIPTION OF PREFERRED EMBODIMENTS

Figure 1:
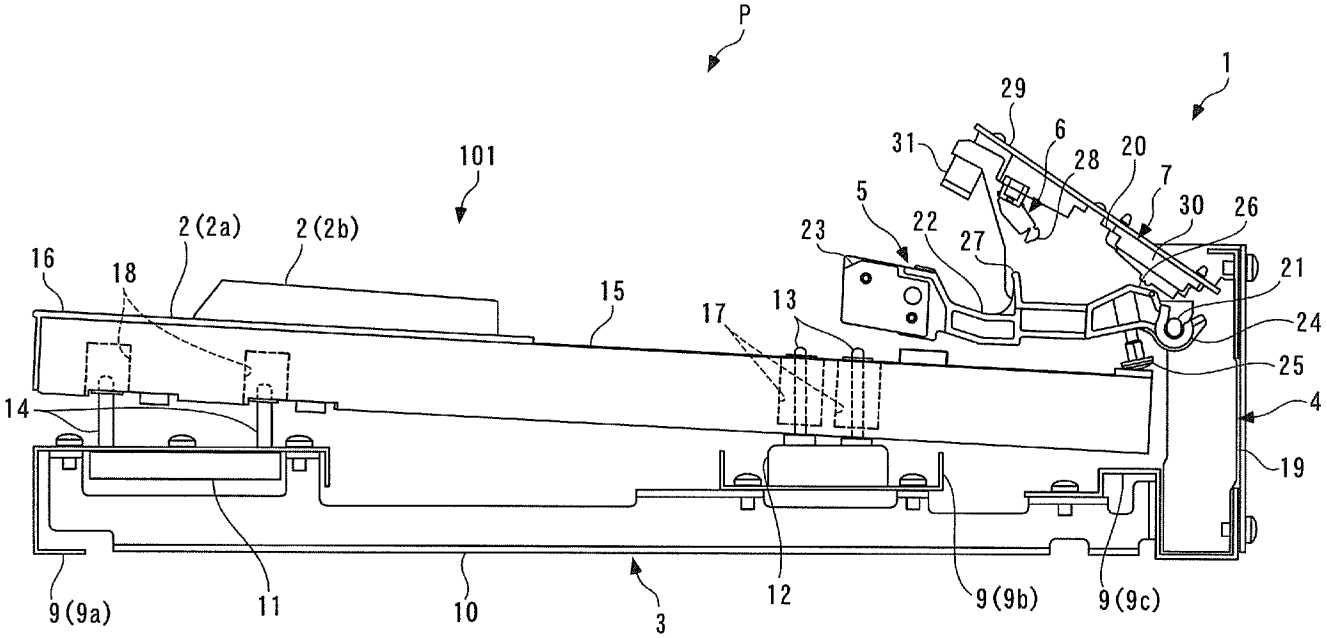
FIG. 1 is a partially cut-away side view of a keyboard device including a hammer device according to an embodiment of the present invention and a keyboard device of an electronic keyboard instrument to which the keyboard device is applied, in a key-released state.

The present invention will now be described in detail with reference to the drawings showing preferred embodiments thereof. As shown in FIG. 1, a hammer device 1 is a part of a keyboard device 101 and is applied to an electronic piano P as an electronic keyboard instrument.

The keyboard device includes a plurality of keys 2 (only one of white keys 2*a* and one of black keys 2*b* are shown) arranged side by side in a left-right direction (near side-far side direction, as viewed in FIG. 1), a keyboard chassis 3 for supporting the keys 2, a hammer support 4 connected to the rear end (right end, as viewed in FIG. 1) of the keyboard chassis 3, a plurality of hammers 5 (only one of which is shown) each provided for an associated one of the keys 2 for being pivotally moved in accordance with depression of the key 2, a plurality of let-off members 6 (only one of which is shown) each provided for an associated one of the hammers 5 for imparting let-off feeling to touch feeling of the associated key 2 when the key 2 is depressed, and a key switch 7 for detecting key depression information on the keys 2.

The keyboard chassis 3 is formed by assembling three support rails 9, i.e. a front rail 9*a*, a center rail 9*b*, and a rear rail 9*c* each extending in the left-right direction, and five reinforcement ribs 10 extending in the front-rear direction, in parallel crosses. The keyboard chassis 3 is rigidly secured on a horizontal keybed (not shown). Each of the support rails 9 and the ribs 10 is formed by an iron plate which is press-punched and bent into a predetermined shape. Each of the support rails 9 is formed to have a reduced thickness (e.g. 1.0 mm) for reduction of weight, whereas each of the ribs 10 is formed to have an increased thickness (e.g. 1.6 mm) for reinforcement.

A keyframe front 11 is rigidly secured to the lower surface of the front rail 9*a*, and a keyframe center 12 is rigidly secured to the upper surface of the center rail 9*a*. The keyframe front 11 and the keyframe center 12 each formed as a thick flat plate member of a synthetic resin extend in the left-right direction along the entire front rail 9*a* and the entire center rail 9*b*, respectively. On the keyframe center 12, a plurality of balance pins 13 are erected at respective front and rear locations facing the white keys 2*a* and the black keys 2*b*, respectively, in a side-by-side arrangement in the left-right direction. Further, on the keyframe front 11, a plurality of front pins 14 are erected at respective front and rear locations facing the white keys 2*a* and the black keys 2*b*, respectively, in a side-by-side arrangement in the left-right direction.

Each of the keys 2 includes a wooden key body 15 extending in the front-rear direction and having a rectangular cross section and a key cover 16 made of a synthetic resin and bonded to the top and front surfaces of a front half of the key body 15. A portion of the key body 15 rearward of the center of the key body 15 in the front-rear direction is formed with a balance pin hole 17, and the key 2 is pivotally supported by an associated one of the balance pins 13, which is inserted in the balance pin hole 17. Further, a front end of the key body 15 is formed with a front pin hole 18, and engagement between the front pin hole 18 and the front pin 14 prevents the key 2 from laterally swinging during a pivotal movement thereof. Further, a cloth C made e.g. of felt is affixed to the upper surface of the rear end of the key 2.

The hammer support 4 is made of a synthetic resin and formed by connecting a plurality of molded articles each corresponding e.g. to one octave to each other. The hammer support 4 extends over the length of all the hammers 5 in the left-right direction, and is screwed to the rear rail 9*c* of the keyboard chassis 3. The hammer support 4 includes a hammer supporting part 19 erected from the rear rail 9*c* and a switch mounting part 20 extending forward and obliquely upward from the upper end of the hammer supporting part 19. The upper end of the hammer supporting part 19 is formed with horizontal pin-shaped fulcrum shafts 21 for supporting the respective hammers 5.

Each of the hammers 5 includes an arm-like hammer body 22 extending in the front-rear direction and weight plates 23 (only one of which is shown) attached to the respective left and right side surfaces of the front end of the hammer body 22. The hammer body 22 is formed by a molded article of a synthetic resin, while the weight plates 23 are each made of a metal material, such as a ferrous material, having a relatively high specific gravity. The hammer body 22 has a rear end thereof formed as a shaft hole part 24, and the shaft hole part 24 has an arcuate shaft hole 24*a* (see FIGS. 8A and 8B and FIGS. 10A and 10B) formed therein. The shaft hole 24*a* is fitted on the fulcrum shaft 21, whereby the hammer 5 is pivotally supported by the hammer support 4. When the key 2 is in a key-released state, the fulcrum shaft 21 and a gravity center GG of the hammer 5 are positioned at substantially the same height (see FIG. 2).

Figure 2:
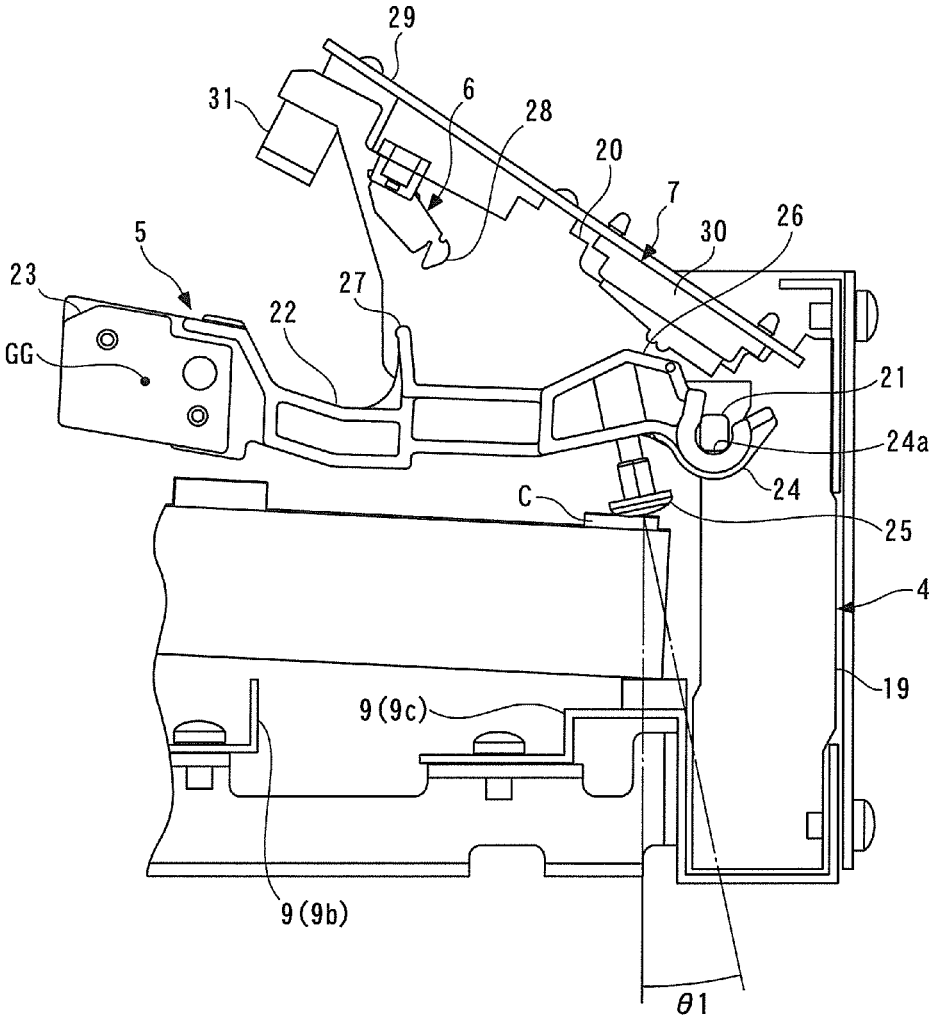
FIG. 2 is a partial enlarged side view of part of FIG. 1.

A capstan screw 25 extends vertically as viewed from the front, and is held in contact with the rear end of the key 2 via the cloth C. The hammer 5 is placed on the rear end of the key 2 via the capstan screw 25. As shown in FIG. 2, when the key 2 is in the key-released state, the capstan screw 25 is slightly inclined forward with respect to the vertical direction, and the angle of the capstan screw 25 with respect to the vertical direction in this state (hereinafter referred to as "the capstan angle"), as viewed laterally (i.e. as viewed in one of the left and right directions), is set to a first predetermined value θ 1.

The capstan screw 25 is screwed into the lower surface of the hammer body 22 at a location immediately forward of the shaft hole part 24 such that the capstan screw 25 can be screwed in and out. The hammer 5 is placed on the rear end of the associated key 2 via the capstan screw 25, and a portion of the upper surface of the hammer body 22 between the shaft hole part 24 and the capstan screw 25 functions as an actuator portion 26 for causing the key switch 7 to operate during key depression. Further, on a central portion of the upper surface of the hammer body 22 in the front-rear direction, there is formed a plate-like engaging projection 27 that is brought into engagement with an associated one of the let-off members 6 during key depression.

Each let-off member 6 is formed by a molded article of a predetermined elastic material (e.g. styrene-based thermoplastic elastomer), and is mounted to the switch mounting part 20 of the hammer support 4. The let-off member 6 extends obliquely rearward and downward from the switch mounting part 20, and has an end thereof formed as a head part 28 protruding from a neck part. In a key-released state, the head part 28 is opposed to the engaging projection 27 of the hammer 5.

The key switch 7 includes a switch board 29 formed by a printed circuit board and switch bodies 30 each formed by a rubber switch and attached to the lower surface of the switch board 29 in association with the respective keys 2. The switch board 29 has a rear end thereof inserted in the switch mounting part 20 and a front end and a central portion thereof screwed to the switch mounting part 20. In the key-released state, the switch body 30 faces the actuator portion 26 of the hammer 5 with a slight spacing therefrom. On the front end of the lower surface of the switch mounting part 20, there is provided a hammer stopper 31 made e.g. of foamed urethane and configured to restrict an upward pivotal movement of the hammer 5.

Next, a description will be given of the operation of the keyboard device 101 configured as above. When depressed in the key-released state shown in FIG. 1, the key 2 is pivotally moved about the balance pin 13 in the counterclockwise direction as viewed in FIG. 1, and in accordance with this pivotal movement of the key 2, the hammer 5 is pushed up by the key 2 via the capstan screw 25 to perform upward pivotal movement (clockwise as viewed in FIG. 1) about the fulcrum shaft 21.

At a time halfway through the pivotal movement of the hammer 5, the engaging projection 27 is brought into engagement with the head part 28 of the let-off member 6 and presses the let-off member 6 while compressing the same via the head part 28, whereby reaction force acting on the hammer 5 from the let-off member 6 is increased. When the hammer 5 is further pivotally moved, the engaging projection 27 is disengaged from the head part 28, whereby the reaction force from the let-off member 6 vanishes. The increase and vanishment of the reaction force from the let-off member 6 provides let-off feeling closely similar to let-off feeling provided by an acoustic piano.

Figure 3:
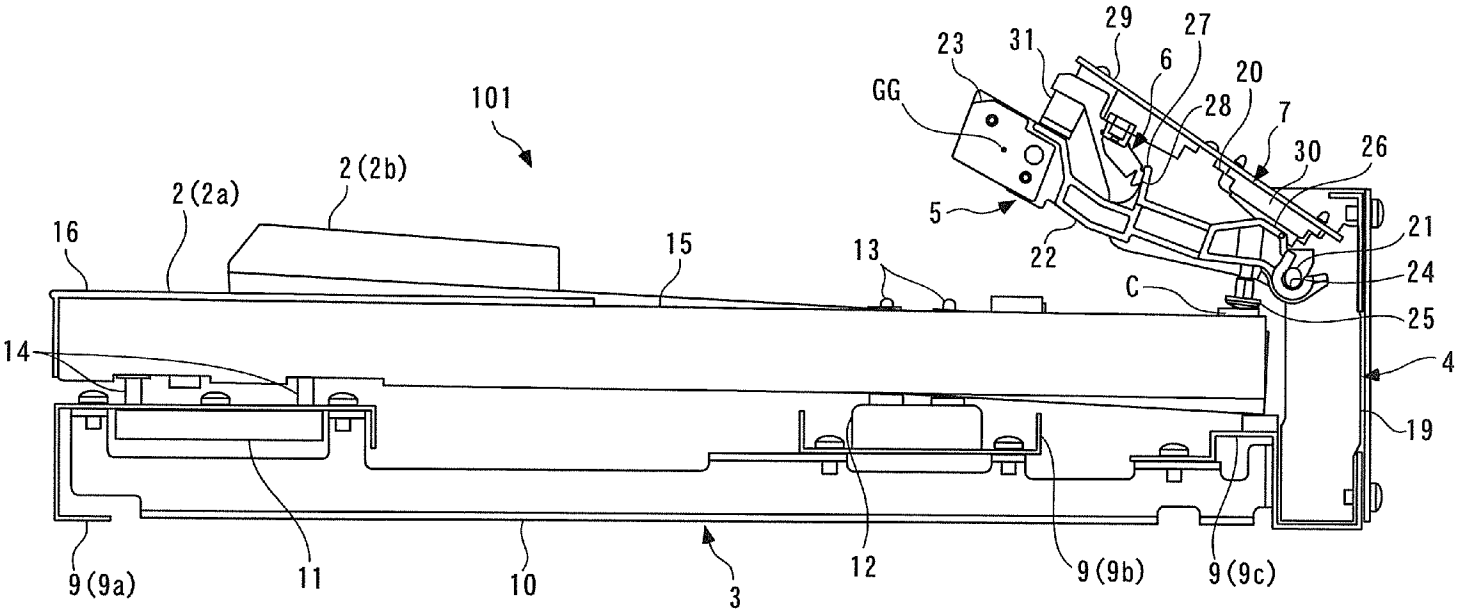
FIG. 3 is a partially cut-away side view of the keyboard device in FIG. 1 in a state where a key has been fully depressed.

Then, when the key 2 is fully depressed as shown in FIG. 3, the hammer 5 comes into abutment with the hammer stopper 31, whereby the upward pivotal movement of the hammer 5 is stopped. During the upward pivotal movement of the hammer 5, the actuator portion 26 presses the switch body 30 of the associated key switch 7 to thereby turn on the key switch 7, whereby key depression information on the key 2 corresponding to the pivotal speed of the hammer 5 is detected and output to a tone generation controller (not shown). The tone generation controller controls the tone generation of the electronic piano based on the detected key depression information.

Thereafter, when the key 2 is released, the key 2 is pivotally moved in a direction reverse to the direction in which the key 2 is pivotally moved when depressed, and returns to the key-released state shown in FIG. 1. As the key 2 returns to the key-released state, the hammer 5 is also pivotally moved downward and returns to its key-released state.

Figure 4A:
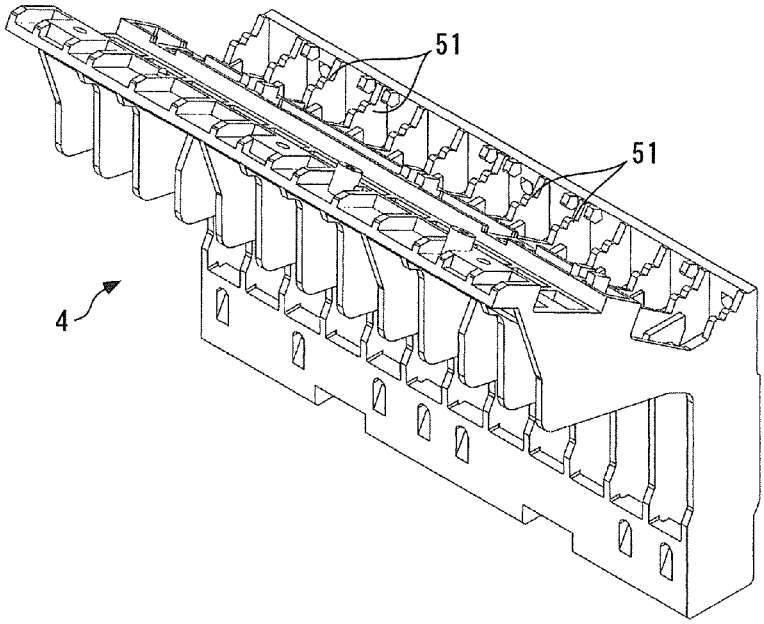
FIG. 4A is a perspective view of a hammer support for one octave.
Figure 4B:
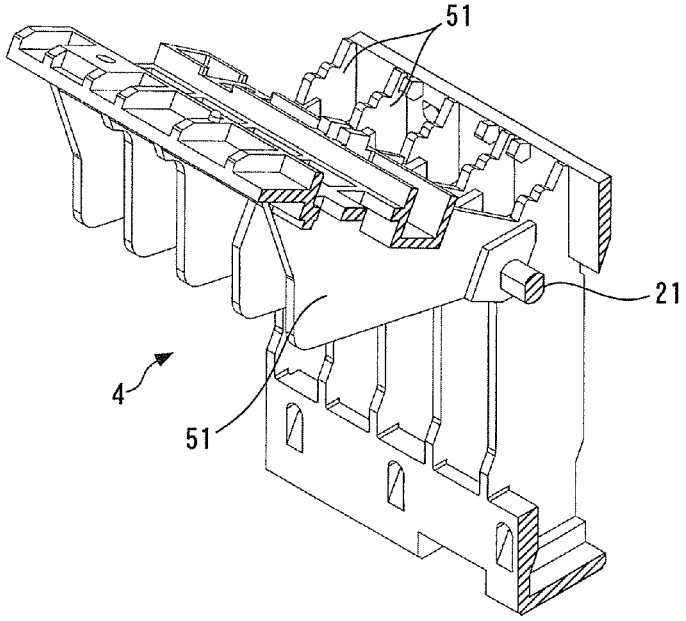
FIG. 4B is a partially cut-away perspective view of the hammer support.
Figure 5:
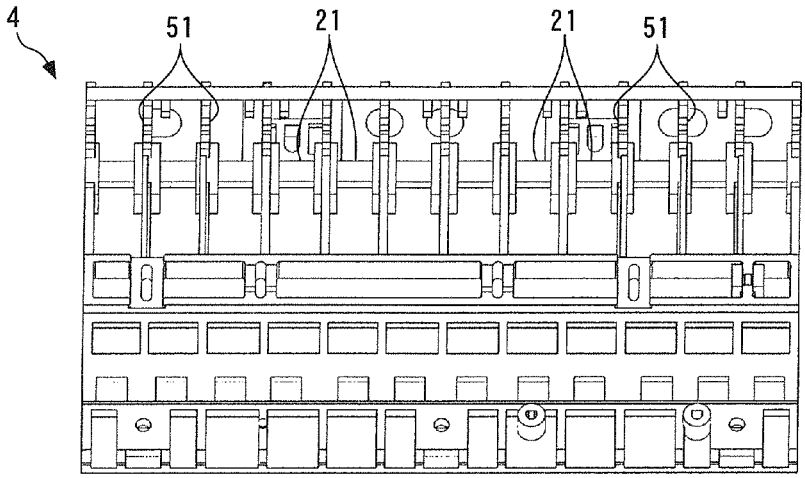
FIG. 5 is a plan view of the hammer support.

Next, the hammer device 1 according to the present embodiment will be described in detail with reference to FIGS. 4A and 4B to FIGS. 10A and 10B by taking a hammer for a white key 2*a* as an example. As described hereinbefore, the hammer device 1 includes the hammer support 4 and the hammers 5, and the hammer support 4 is made of a synthetic resin, and a resin-molded article corresponding to a one-octave part of the hammer support 4, shown in FIGS. 4A and 5, is manufactured by injection molding.

Figure 6:
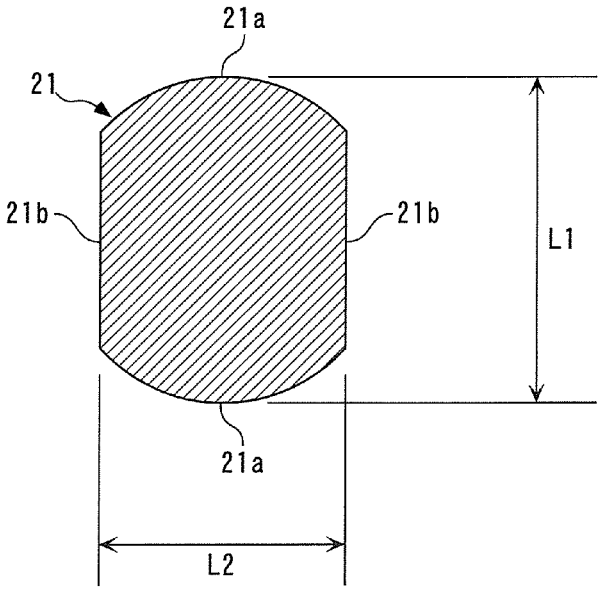
FIG. 6 is a cross-sectional view of a fulcrum shaft of the hammer support.

The hammer support 4 has a plurality of partition walls 51 each for separating hammers 5 adjacent to each other in the left-right direction with a predetermined space therebetween, and the fulcrum shaft 21 extends between the adjacent partition walls 51 and 51 in the left-right direction. As shown in FIG. 6, the fulcrum shaft 21 has an oval-like cross-section formed by cutting away diametrically opposite portions from a circle having the axis of the fulcrum shaft 21 as its center. The outer peripheral surface of the fulcrum shaft 21 is formed by a pair of arcuately-curved surface portions 21*a* and 21*a* and a pair of planar surface portions 21*b* and 21*b* each extending between the arcuately-curved surface portions 21*a* and 21*a*.

The arcuately-curved surface portions 21*a* and 21*a* are disposed opposite to each other and point-symmetrical with respect to the axis of the fulcrum shaft 21, and the planar surface portions 21*b* and 21*b* extend parallel to each other in point-symmetrical relation with respect to the axis of the fulcrum shaft 21. With this configuration, in the fulcrum shaft 21, a vertex-to-vertex distance L1 between the arcuately-curved surface portions 21*a* and 21*a* is set to a larger value than a distance L2 between the planar surface portions 21*b* and 21*b*.

Figure 7:
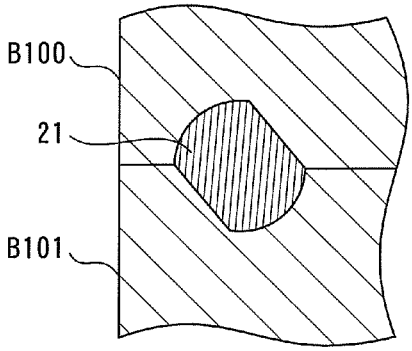
FIG. 7 is a cross-sectional view showing the positional relationship between a mold parting line and the fulcrum shaft in a case where the hammer support is manufactured by injection molding.

In the case of manufacturing the hammer support 4, two molds B100 and B101 are used, as shown in FIG. 7, to form the fulcrum shaft 21, and a parting line between the two molds are set such that the parting line coincides with two boundaries (hereinafter referred to as "the line boundary portions"), which are opposite to each other via the axis of the fulcrum shaft 21, of four boundaries (hereinafter referred to as "the boundary portions") between the arcuately-curved surface portions 21*a* and the planar surface portions 21*b*. The reason for this will be described hereinafter.

Figure 8A:
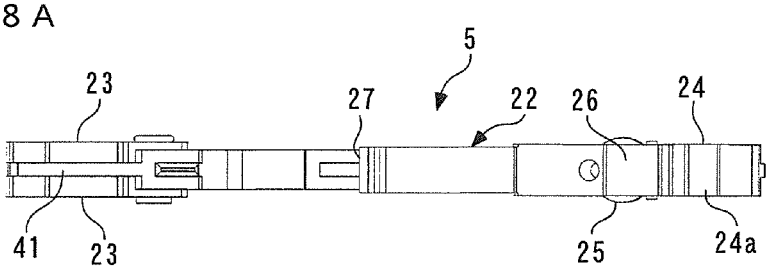
Figure 8B:
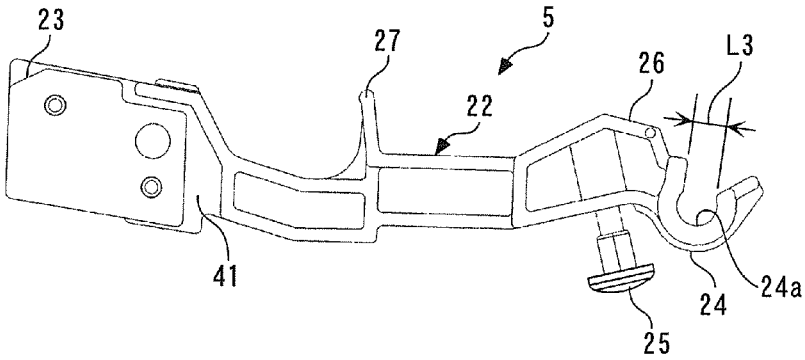

On the other hand, the hammer 5 for the white key 2*a* has a hammer body 22 basically formed in lateral symmetry, as shown in FIGS. 8A and 8B, and the hammer body 22 has a front end formed as a relatively thin plate-like weight mounting part 41 having a predetermined thickness. The plate-like weight plates 23 and 23 are riveted to the respective left and right sides of the weight mounting part 41.

The shaft hole 24*a* of the shaft hole part 24 of the hammer body 22 has an inner peripheral surface thereof formed into an arcuate shape or an upwardly open C shape in side view. In the case of this shaft hole 24*a*, a width L3 of its opening (see FIG. 8B) is set to be slightly smaller than the vertex-to-vertex distance L1 between the arcuately-curved surface portions 21*a* and 21*a* and slightly larger than the distance L2 between the planar surface portions 21*b* and 21*b*. Further, the diameter of the arc formed by the inner peripheral surface is set to be slightly larger than the vertex-to-vertex distance L1 between the arcuately-curved surface portions 21*a* and 21*a*. With this configuration, the hammer 5 can be mounted and dismounted to and from the fulcrum shaft 21 via the opening of the shaft hole 24*a* of the hammer body 22.

Figure 9A:
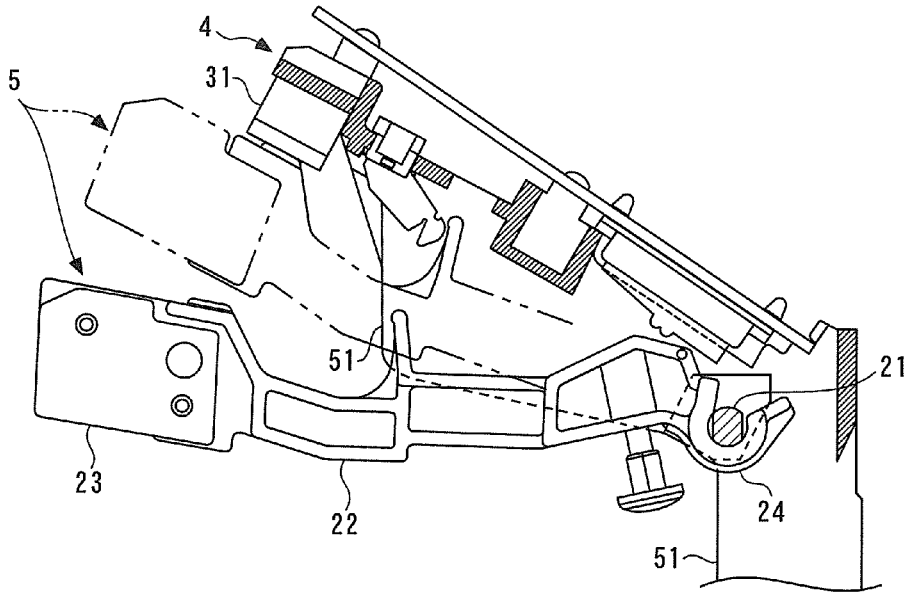
FIG. 9A is a view useful in explaining the operation of the hammer in a key-depressed state.
Figure 10A:
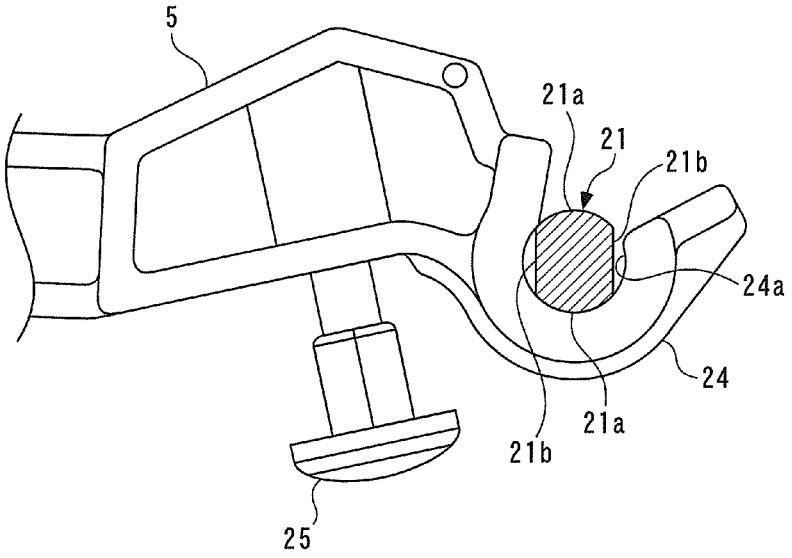

In the key-released state, the hammer 5 is held at its home position indicated by solid lines in FIG. 9A, and in this state, the fulcrum shaft 21 is held in a state where part of its upper arcuately-curved surface portion 21*a* and all of its lower arcuately-curved surface portion 21*a* are in contact with the inner peripheral surface of the shaft hole 24*a*, as shown in FIGS. 9A and 10A. On the other hand, when the key is depressed, the hammer 5 is pivotally moved from its home position to a turning limit position indicated by two-dot chain lines in FIG. 9A, and then returns to its home position. In this case, when the hammer 5 is at the turning limit position, the fulcrum shaft 21 is held in a state where part of its upper arcuately-curved surface portion 21*a* and all of its lower arcuately-curved surface portion 21*a* are in contact with the inner peripheral surface of the shaft hole 24*a*, as indicated by solid lines in FIG. 10B. Thus, the hammer 5 is supported on the fulcrum shaft 21 in a state prevented from coming off not only during pivotal movement, but also during stoppage.

Figure 9B:
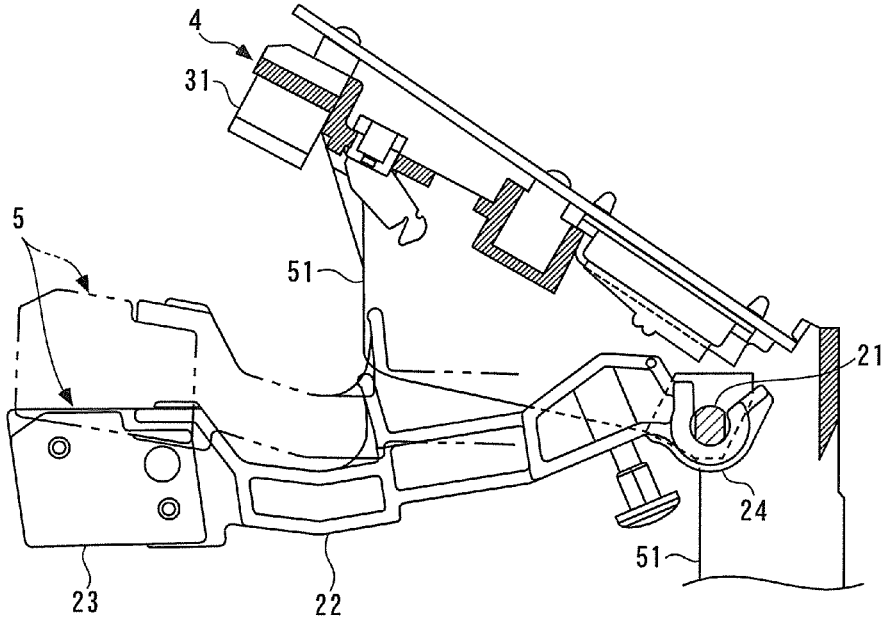
FIG. 9B is a view useful in explaining an operation for dismounting the hammer.

On the other hand, in the case of dismounting the hammer 5 from the hammer support 4, the key 2 on which the hammer 5 is placed via the capstan screw 25 is dismounted from the keyboard device, and then the hammer 5 is pivotally moved downward through a predetermined angle from its home position indicated by two-dot chain lines in FIG. 9B to a position indicated by solid lines in FIG. 9B. As a consequence, the hammer 5 assumes a posture in which the opening of the shaft hole 24*a* faces just upward, so that it is possible to dismount the hammer 5 from the fulcrum shaft 21 simply by moving the shaft hole part 24 of the hammer 5 downward.

As described above in detail, according to the hammer device 1 of the present embodiment, the hammer 5 is pivotally moved about the fulcrum shaft 21 of the hammer support 4, and the outer peripheral surface of the fulcrum shaft 21 is formed by the pair of arcuately-curved surface portions 21*a* and 21*a* and the pair of planar surface portions 21*b* and 21*b*. As described hereinabove, when manufacturing the hammer support 4 by injection molding, the parting line between the two molds B100 and B101 is set to coincide with the two line boundary portions, so that even when parting line marks are generated on the fulcrum shaft 21, portions having the marks thereon coincide with the two line boundary portions. Since the hammer 5 is pivotally moved with the inner peripheral surface of its shaft hole 24*a* in surface contact with the arcuately-curved surface portions

21*a* and 21*a*, at least one of the parting line marks on the two line boundary portions is elastically deformed during the pivotal movement of the hammer 5 in a manner bent toward the planar surface portions 21*b*, so that smooth pivotal movement of the hammer 5 is not hindered. Thus, a cutting process for removing the parting line marks and the like can be dispensed with, which contributes to reduction of the number of manufacturing steps and manufacturing costs.

Further, the width L3 of the opening of the shaft hole 24*a* is set to be slightly smaller than the vertex-to-vertex distance L1 between the arcuately-curved surface portions 21*a* and 21*a* and slightly larger than the distance L2 between the planar surface portions 21*b* and 21*b*, and the diameter of the arc formed by the inner peripheral surface is set to be slightly larger than the vertex-to-vertex distance L1 between the arcuately-curved surface portions 21*a* and 21*a*. This enables, during maintenance, after dismounting the key 2, a worker to pivotally move the hammer 5 to a position where the center of one of the arcuately-curved surface portions 21*a* coincides with that of the opening of the shaft hole 24*a*, and then move the hammer 5 downward to thereby dismount the same from the hammer support 4. Further, the worker can mount the hammer 5 to the hammer support 4 by carrying out operations reverse to the above dismounting operations. In short, the worker can mount and dismount the hammer 5 to and from the hammer support 4 simply by manually turning the hammer 5, without carrying out any screw-in and screw-out operations, which contributes to improvement of workability during maintenance.

In addition, the hammer 5 is held in contact with the upper surface of the key 2 via the capstan screw 25, and when the key 2 swings in accordance with key depression, the capstan screw 25 is pushed upward by the key 2, whereby the hammer 5 is pivotally moved about the fulcrum shaft 21. Therefore, it is possible to appropriately support an upward force acting on the fulcrum shaft 21 when the key 2 starts to swing, by the whole lower arcuately-curved surface portion 21*a* of the fulcrum shaft 21.

Figure 10B:
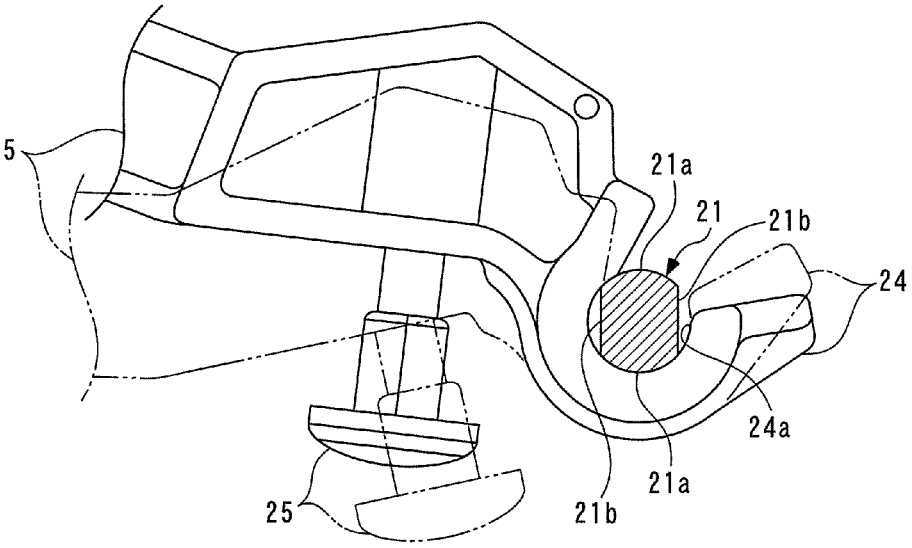

As is apparent from FIGS. 10A and 10B, one of the four boundary portions is positioned within the opening of the shaft hole 24*a* during both of stoppage and pivotal movement of the hammer 5. Therefore, when one of the boundary portions is set as a line boundary portion, only one of the parting line marks on the two line boundary portions is in contact with the inner peripheral surface of the shaft hole 24*a* during pivotal movement of the hammer 5. This makes it possible to achieve further smooth pivotal movement of the hammer 5.

Figure 11:
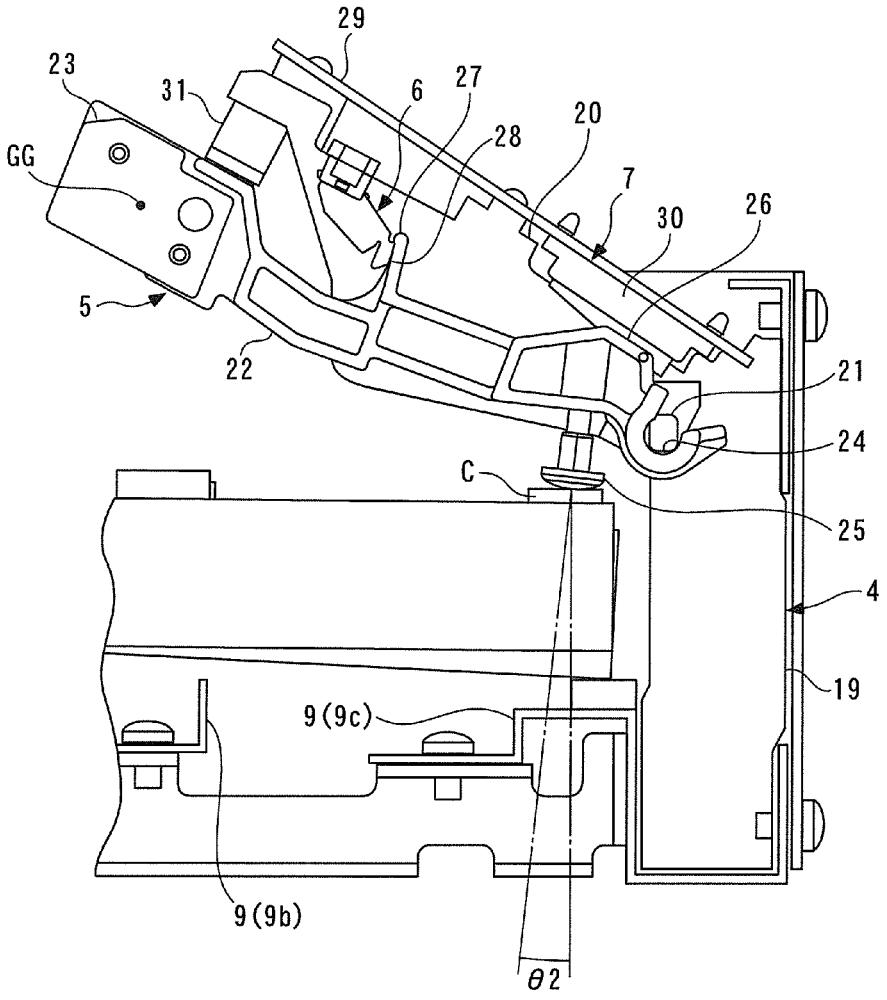
FIG. 11 is a partial enlarged side view of FIG. 2.

Further, as shown in FIG. 11, in a state where the key 2 has been fully depressed, the capstan screw 25 is slightly inclined rearward with respect to the vertical direction, and the capstan angle in this state is set to a second predetermined value θ 2. As is apparent from comparison between FIG. 11, and FIG. 2, referred to hereinabove, the second predetermined value θ 2 is set to be smaller than the first predetermined value θ 1 set as a capstan angle in the key-released state of the key 2.

As described above, according to the present embodiment, the capstan angle is set such that a value (second predetermined value θ 2) thereof in the fully depressed state of the key 2, i.e. in a state where key depression has been completed is smaller than a value (first predetermined value θ 1) thereof in the key-released state of the key 2. This makes it possible to reduce a force component which acts in a direction at right angles to the axis of the capstan screw 25 of a reaction force of the hammer 5 which acts vertically, when the key 2 is depressed, i.e. over a time period from the start of a key depression to the end of the same, to thereby appropriately transmit the reaction force of the hammer 5 to the key 2 via the capstan screw 25. This makes it possible to secure sufficient touch weight during key depression and thereby provide excellent musical performance capability. In particular, differently from the conventional keyboard device described hereinabove, it is possible to secure sufficient touch weight immediately before the termination of key depression, which enables effective provision of excellent performance capability.

Further, when the key 2 is in the key-released state, the fulcrum shaft 21 and the gravity center GG of the hammer 5 are positioned at substantially the same height, so that it is possible to reduce a force component which acts in the lengthwise direction of the hammer 5, of the reaction force (gravity) of the hammer 5 than when the fulcrum shaft 21 is lower than the gravity center GG of the hammer 5, to thereby increase the reaction force of the hammer 5 that acts on the key 2 during key depression. Thus, it is possible to more effectively obtain the above-mentioned advantageous effect that sufficient touch weight can be secured during key depression so as to obtain more excellent musical performance capability.

If a capstan screw is configured, differently from the keyboard device 101 of the present embodiment, such that it is inclined forward both when an associated key is in the key-released state and when the key is fully depressed, or if a capstan screw is configured such that it is inclined forward when an associated key is in the key-released state and stands upright when the key is fully depressed, the capstan angle in the key-released state is very large. As a consequence, a large capstan angle at the initial stage of a key depression results in inappropriate transmission of the reaction force of an associated hammer to the key via the capstan screw, which results in insufficient touch weight. In contrast, according to the present embodiment, the capstan screw 25 is inclined forward when the key 2 is in the key-released state and is inclined rearward when the key 2 is fully depressed, as shown in FIGS. 1 and 3. This reduces the capstan angle in the key-released state of the key 2, and hence it is possible to obtain sufficient touch weight at the initial stage of a key depression.

Figure 12:
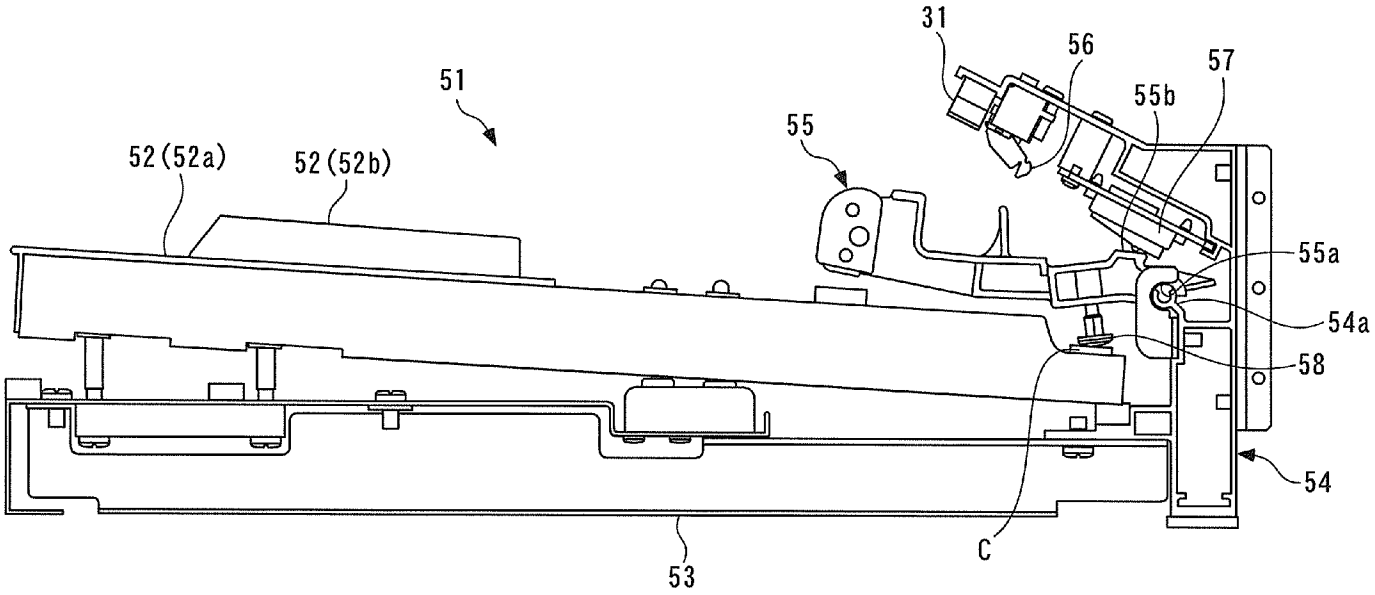
FIG. 12 is a partially cut-away side view of a comparative example of the keyboard device for an electronic piano in a state where a key is in a key-released state.
Figure 13:
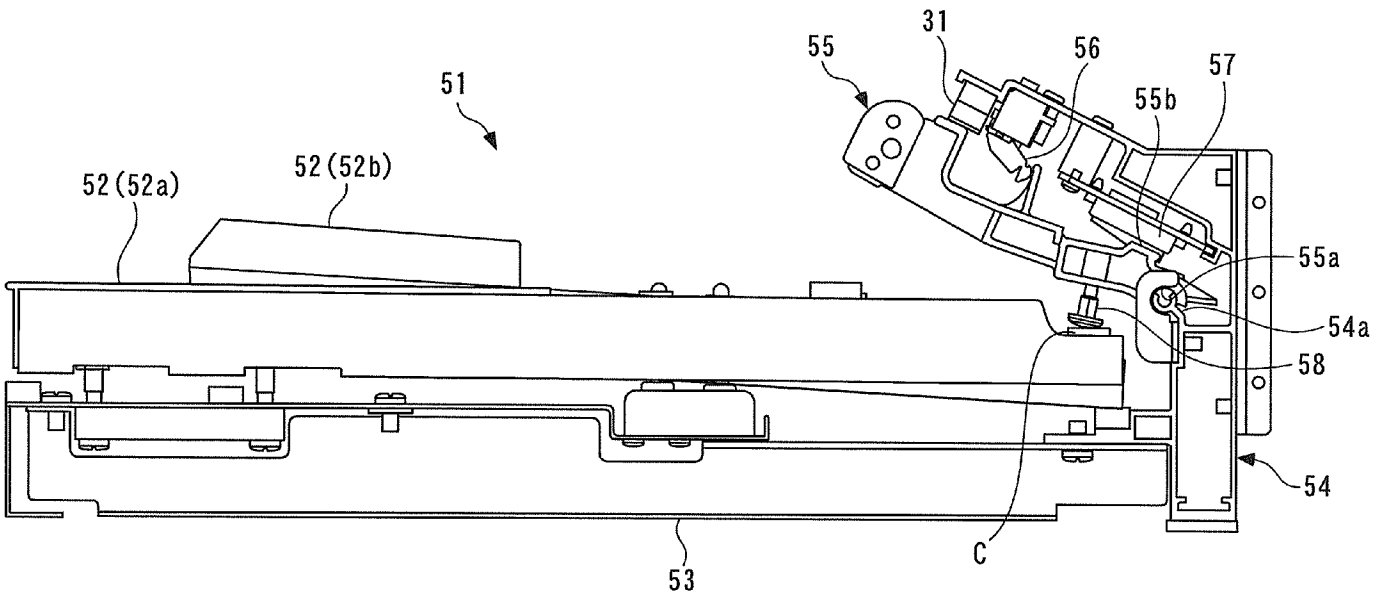
FIG. 13 is a partially cut-away side view of the keyboard device in FIG. 12 in a state where a key has been fully depressed.

FIGS. 12 and 13 show a keyboard device 151 for an electronic piano, according to a comparative example. The keyboard device 151 has substantially the same arrangement as the keyboard device 101 of the present embodiment, and therefore only a brief description will be given of the arrangement and operation of the keyboard device 151. The keyboard device 151 includes a plurality of keys 52 (only one of white keys 52*a* and one of black keys 52*b* are shown) arranged side by side in a left-right direction (near side-far side direction, as viewed in FIG. 12) of the electronic piano, a keyboard chassis 53 that supports the keys 52 such that each of the keys 52 can swing about its central portion, a hammer support 54 connected to the rear end (right end as viewed in FIG. 12) of the keyboard chassis 53, a plurality of hammers 55 (only one of which is shown) provided for the respective keys 52, a plurality of let-off members 56 (only one of which is shown) provided for the respective hammers 55, and a key switch 57 for detecting key depression information on the keys 52.

The key 52 has a rear end thereof formed into a step-like shape by having an upper surface thereof cut away, and the cloth C is affixed to the upper surface of the cutaway portion. The hammer 55 has a rear end thereof formed with an arcuate shaft hole 55*a*. The shaft hole 55*a* is engaged with a hammer fulcrum shaft portion 54*a* of the hammer support 54, whereby the hammer 55 is pivotally supported by the hammer support 54. Further, a capstan screw 58 is screwed into the lower surface of the hammer body 55 at a location immediately forward of the shaft hole 55*a*. The capstan screw 58 is held in contact with the rear end of the key 52 via the cloth C. The hammer 55 is placed on the rear end of the key 52 via the capstan screw 58.

In the keyboard device 151 arranged as described above, when depressed in the key-released state shown in FIG. 12, the key 52 is swung counterclockwise, as viewed in FIG. 12, about its central portion in the front-rear direction, and in accordance with this movement of the key 52, the hammer 55 is pushed up via the capstan screw 58 to be pivotally moved upward (clockwise as viewed in FIG. 12) about the hammer fulcrum shaft portion 54*a*. In accordance with this pivotal movement of the hammer 5, the capstan screw 58 slides forward along the cloth C while changing the angle with respect to the vertical direction, as viewed laterally.

Then, when the key 52 is fully depressed as shown in FIG. 13, the hammer 55 is brought into abutment with a hammer stopper 59 provided above the hammer 55, whereby the upward pivotal movement of the hammer 55 is stopped. During the upward pivotal movement of the hammer 55, an actuator portion 55*b* of the hammer 55 presses the key switch 57 to turn on the same, whereby key depression information on the key 52 corresponding to the pivotal speed of the hammer 55 is detected and output to a tone generation controller (not shown). Tone generation by the electronic piano is controlled by the tone generation controller based on the detected key depression information.

Thereafter, when released, the key 52 swings in a direction reverse to the direction in which the key 52 is pivotally moved when depressed, and returns to the key-released state shown in FIG. 12. In accordance with this movement of the key 52, the hammer 5 also pivotally moves downward and returns to its key-released state.

Figure 14A:
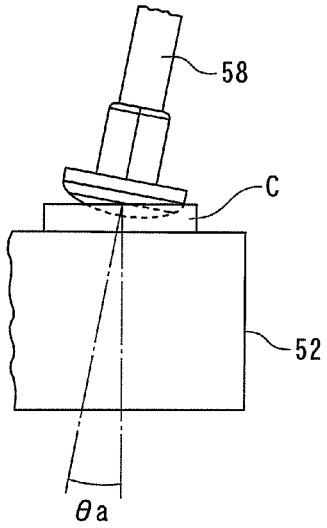
Figure 14B:
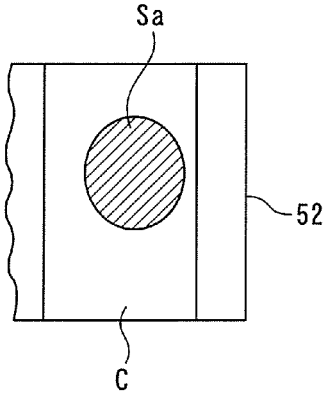

As shown in FIG. 14A, in the fully depressed state of the key 52, an angle θ a of the capstan screw 58, as viewed laterally, with respect to the vertical line perpendicular to the cloth C is relatively large. For this reason, a contact area Sa of the capstan screw 58 on the cloth C in the fully depressed state of the key 52 is relatively small, as shown in FIG. 14B.

Figure 15A:
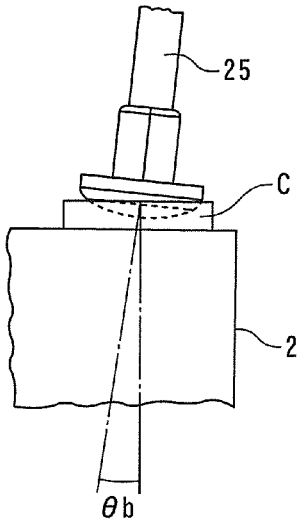
FIG. 15A is a view showing an angle of a capstan screw with respect to a vertical line perpendicular to a cloth in the present embodiment.
Figure 15B:
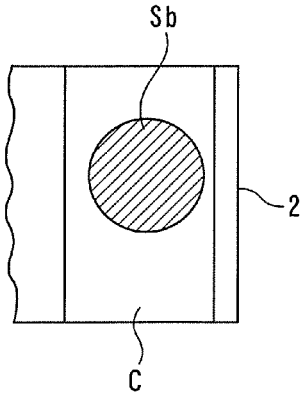
FIG. 15B is a view showing a contact area of the capstan screw on the cloth in the present embodiment.
Figure 16:
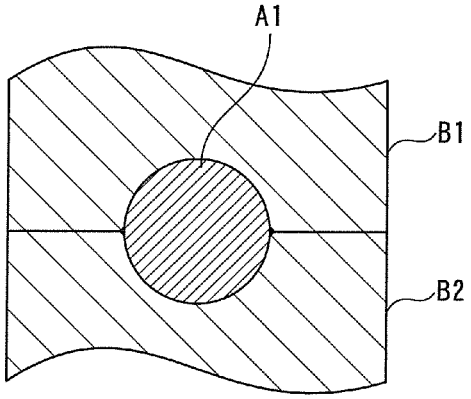
FIG. 16 RELATED ART
FIG. 16 is a cross-sectional view showing the positional relationship between a mold parting line and a fulcrum shaft in a conventional hammer device in a case where the fulcrum shaft is manufactured by injection molding.

On the other hand, according to the keyboard device 101 of the present embodiment, as shown in FIG. 15A, in the fully depressed state of the key 2, an angle θ b of the capstan screw 25, as viewed laterally, with respect to the vertical line orthogonal to the cloth C is smaller than in the comparative example in FIG. 14A (i.e. the angle θ a). For this reason, a contact area Sb of the capstan screw 25 on the cloth C in the fully depressed state of the key 2 is larger than in the comparative example in FIG. 14B (i.e. the contact area Sa), as shown in FIG. 15B. Thus, a true or effective contact area of the capstan screw 25 on the cloth C can be increased when the capstan screw 25 slides along the cloth C during key depression of the key 2, so that it is possible to increase friction between the capstan screw 25 and the cloth C to thereby obtain larger touch weight.

It should be noted that the present invention is by no means limited to the embodiment described above, but it can be practiced in various forms. For example, although in the present embodiment, the capstan screw 25 is provided on the hammer 5 and is in contact with the key 2, it may be provided on the key 2 and be in contact with the hammer 5. Further, although in the present embodiment, the capstan screw 25 is configured to be inclined forward in the key-released state of the key 2 and be inclined rearward when the key 2 is fully depressed, the capstan screw 25 may be configured as follows insofar as the capstan angle is smaller in the fully depressed state of the key 2 than in the key-released state: The capstan screw 25 may be configured to be inclined forward both when the key 2 is in the key-released state and when the key 2 is fully depressed, or may be configured to be inclined forward when the key 2 is in the key-released state and stand upright when the key 2 is fully depressed.

Although in the present embodiment, the hammer device of the present invention is applied to an electronic piano as an electronic keyboard instrument, this is not limitative, but the present invention is applicable to any other electronic keyboard instrument having keys swingable by key depression. For example, the hammer device of the present invention may be applied to an electronic keyboard instrument of an organ type.

Further, although in the present embodiment, the keyboard device of the present invention is applied to an electronic piano, this is not limitative, but the present invention is applicable to the keyboard device of any other appropriate electronic keyboard instrument, such as a synthesizer.

It is further understood by those skilled in the art that the foregoing is a preferred embodiment of the invention, and that various changes and modifications may be made without departing from the spirit and scope thereof.

What is claimed is:

1. A keyboard device for an electronic keyboard instrument, comprising:

a key that extends in a front-rear direction and is swingable about its center or portion close thereto;

a hammer that is a monolithic and rigid member and pivotally movable about a fixed hammer fulcrum; and a capstan screw that is provided on one of said key and said hammer and is in contact, in a longitudinal axis, with the other of said key and said hammer, wherein said hammer is placed directly on a rear end of said key via said capstan screw, and is pushed up by said key in accordance with depression of said key to perform upward pivotal movement and come into abutment with a fixed hammer stopper, and wherein an angle of the longitudinal axis of said capstan screw, as viewed laterally, with respect to a vertical direction is set to be smaller when said key is in a fully depressed state than when said key is in a key-released state.

2. The keyboard device according to claim 1, wherein when said key is in the key-released state, said hammer fulcrum and a gravity center of said hammer are positioned at substantially same height.

* * * * *